US006470262B2

(12) United States Patent
Kerner et al.

(10) Patent No.: US 6,470,262 B2
(45) Date of Patent: Oct. 22, 2002

(54) METHOD FOR TRAFFIC SITUATION DETERMINATION ON THE BASIS OF REPORTING VEHICLE DATA FOR A TRAFFIC NETWORK WITH TRAFFIC-CONTROLLED NETWORK NODES

(75) Inventors: Boris Kerner, Stuttgart; Hubert Rehborn, Fellbach, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/851,993

(22) Filed: May 10, 2001

(65) Prior Publication Data

US 2002/0026277 A1 Feb. 28, 2002

(30) Foreign Application Priority Data

May 10, 2000 (DE) ..... 100 22 812

(51) Int. Cl.[7] ..... G08G 1/00; G08G 1/01

(52) U.S. Cl. ..... 701/117; 701/200-215; 701/118; 701/119; 701/23-26; 340/905; 340/934; 340/995; 340/988; 340/989; 340/990; 455/456; 180/65.8; 320/107

(58) Field of Search ..... 701/200–215, 701/117–119, 23–26; 340/905, 934, 995, 988, 989, 990; 455/456; 180/65.8; 320/107

(56) References Cited

U.S. PATENT DOCUMENTS

| | | | | | |
|---|---|---|---|---|---|
| 5,173,691 | A | * | 12/1992 | Sumner | 340/905 |
| 5,296,852 | A | * | 3/1994 | Rathi | 340/933 |
| 5,845,227 | A | * | 12/1998 | Peterson | 340/905 |
| 5,878,368 | A | * | 3/1999 | DeGraff | 340/988 |
| 5,986,575 | A | * | 11/1999 | Jones et al. | 340/906 |
| 6,012,012 | A | * | 1/2000 | Fleck et al. | 340/905 |
| 6,169,902 | B1 | * | 1/2001 | Kawamoto | 455/456 |
| 6,259,405 | B1 | * | 7/2001 | Stewart et al. | 342/457 |
| 2001/0029425 | A1 | * | 10/2001 | Myr | 701/200 |

FOREIGN PATENT DOCUMENTS

DE 19753034 6/1999

* cited by examiner

*Primary Examiner*—William A. Cuchlinski, Jr.
*Assistant Examiner*—Ronnie Mancho
(74) *Attorney, Agent, or Firm*—Crowell & Moring LLP

(57) ABSTRACT

A method for determining the traffic situation is based on traffic data which are obtained from reporting vehicles moving in the traffic, for a traffic network with traffic-controlled network nodes and roadway sections connecting them. Traffic data indicative of travel times on the roadway sections are obtained by reporting vehicles moving in the traffic, and are used to determine travel times on a roadway-section-specific basis. The mean number of vehicles in the queue, the mean number of vehicles, the mean vehicle speed outside the queue, the mean waiting time in the queue and/or the mean vehicle density outside the queue are determined from these travel times for the respective roadway section.

10 Claims, 3 Drawing Sheets

METHOD FOR TRAFFIC SITUATION DETERMINATION ON THE BASIS OF REPORTING VEHICLE DATA FOR A TRAFFIC NETWORK WITH TRAFFIC-CONTROLLED NETWORK NODES

This application claims the priority of German patent document 100 22 812.7, filed May 10, 2000, the disclosure of which is expressly incorporated by reference herein.

The invention relates to a method for evaluating a traffic situation for a traffic network with traffic-controlled network nodes and roadway sections connecting them, based on traffic data obtained by reporting vehicles moving in the traffic.

Many methods are known for determining the actual traffic situation and for predicting the traffic situation to be expected in the future, in particular for road traffic networks. Such methods are becoming increasingly important due to the continuous increase in the amount of traffic. Conventional traffic prediction methods can be subdivided roughly into two types, namely historical progress line predictions and dynamic traffic predictions. The former are based on previously obtained traffic situation data from which an archive of so-called progress lines is formed; based on the latter a so-called matching process (in which a best matching progress line is selected) is then used to deduce the future development of the traffic situation from current traffic situation data. Dynamic traffic prediction, on the other hand, is based on identification of objects in the traffic and traffic states (such as free-flowing traffic, synchronized traffic and jams) from current traffic measurements, and dynamic tracking of these individualized traffic states.

These two prediction methods may also be combined. Such historical and dynamic traffic predictions are described, for example, in German Patent Documents DE 195 26 148 C2, DE 196 47 127 A1 and DE 197 53 034 A1, and German Patent Application 198 35 979.9. A necessary precondition for any traffic prediction method is to determine the actual traffic situation at the time of the prediction and, possibly, at earlier times.

Most conventional methods for traffic situation determination are applied to traffic networks in which the dynamics of the traffic flow are themselves governed essentially by the traffic interactions on the various roadway sections (the route connections between each pair of network nodes); that is, such dynamics are governed by the dynamics of the various identifiable traffic objects and phased transitions between them. Such interactions are applicable, for example, to high-speed roads.

On the other hand, different interactions occur in traffic networks in highly populated areas. There, the traffic flow is generally governed by the traffic control measures at the network nodes (for example, traffic lights at crossings), and scarcely at all by the traffic dynamic effects on the frequently relatively short roadway sections between the nodes. It is known that queuing theory can be used in these cases, in which the length of the queue before a particular traffic-controlled network node, the durations of the free phases during which the traffic is released at the relevant network node and interruption phases during which the traffic is stationary at the network node, the speed of the vehicles outside the typical queues before the network nodes, the inlet flows to the queue and the length of the roadway sections are of importance for the traffic dynamics. See, for example, S. Miyata et al., "STREAM", Proc. of the 2nd World Congress on Intelligent Transport Systems, Yokohama, Volume 1, Page 289, 1995 and B. Ran and D. Boyce, "Modeling Dynamic Transportation Networks", Springer-Verlag, Berlin, 1996.

German Patent Application 199 40 957.9 (not prior art) discloses a traffic prediction method which is particularly suitable for traffic networks in highly populated areas. This traffic prediction method is based on detection of actual traffic state parameters, which are formed in discrete time intervals by the free phases and interruption phases at the traffic-controlled network nodes, such as the actual vehicle outlet flow from a queue, the actual vehicle inlet flow into the queue and the actual number of vehicles in the queue. The actual traffic state parameters at discrete time intervals are used to determine effective continuous traffic state parameters, including at least one effective continuous vehicle outlet flow from a queue and/or one effective continuous vehicle inlet flow into the queue. From the latter, one or more traffic parameters is or are predicted on the basis of dynamic macroscopic modeling of the traffic. These include, for example, expected travel time at a prediction time for a specific roadway section and/or the expected traffic situation to be expected, at least with regard to the number of vehicles waiting in queues or traveling outside queues, and/or the predicted length of the respective queue. The contents of this prior Application with regard to the explanatory notes and definitions that can be found there of terminology and physical variables are also relevant here.

A parallel German Patent Application from the applicant discloses a method for obtaining traffic data by means of reporting vehicles moving in the traffic. This system is used to obtain what is referred to as FCD (floating car data), which is likewise especially suitable for traffic networks in highly populated areas (that is, for traffic networks in which the traffic is dominated by traffic controls at the network nodes). This method specifically includes obtaining FCD from dynamic individual or reporting vehicles, with such data including time stamp information denoting a reporting time which is not earlier than the time of leaving the relevant roadway section and is not later than the time at which the reporting vehicle reaches a next traveled roadway section before a next network node to be considered. Such time stamp information allows the routes traveled by the reporting or FCD vehicles to be tracked, and the travel times to be expected for the respective roadway section to be determined, possibly individually for each of a number of direction lane sets in this section. The term "direction lane set" in this case denotes the number of different direction lanes in a roadway section, which may each comprise one or more lanes and are defined in such a way that the one or more lanes in a respective direction lane set can be used equally well by the vehicles in order to pass the network node to continue in one or more associated destination directions. This FCD traffic data acquisition method can be to determine travel times for each respective roadway section for the present traffic situation determination method, as used above.

One object of the invention is to provide an improved method of the type mentioned above, for determining one or more traffic parameters indicative of the traffic situation, using FCD information, particularly for traffic networks in highly populated areas as well.

This and other objects and advantages are achieved by the method according to the invention, in which traffic data indicative of the travel times on the roadway sections (that is, FCD suitable for travel time determination), are obtained by means of reporting vehicles moving in the traffic, and the travel for the roadway sections are determined from such traffic data. The roadway-section-specific travel times which have been determined are then used to obtain one or more traffic situation parameters. More precisely, these include the mean number of vehicles in a queue at a particular roadway section before a traffic-controlled network node, the mean number of vehicles in total on the roadway section, the mean vehicle speed on the roadway section before any queue (between the start of the roadway section and the upstream end of the queue), the mean waiting time in the particular queue and/or the mean vehicle density on the roadway section before the queue.

This method makes it possible to obtain FCD suitable for determining the actual traffic situation with sufficient accuracy, especially for traffic networks in highly populated areas where traffic dynamics are dominated by the traffic control measures at the network nodes, using the FCD for reconstruction. Other recorded traffic data (for example, from fixed-position detectors) can also be taken into account, but this is not essential. The actual traffic situation determined or reconstructed in such a way can then in turn be used as the basis for constructing a progress line database and, as a progression from this, for progress-line-based and/or dynamic traffic predictions. For predicting the traffic situation in a traffic network in a highly populated area, it is important to know the time-dependent queue lengths at the traffic-controlled network nodes, and the time-dependent number of vehicles on the respective roadway section. Such information can be obtained by the method according to the invention.

In one embodiment of the invention, the travel times and traffic situation parameter or parameters are determined separately, specifically for each of, possibly, a number of direction lane sets for a respective roadway section. This allows the accuracy of the traffic situation determination process to be significantly improved, since it takes account of the fact that queues of different lengths are generally formed for different direction lane sets before a traffic-controlled network node on a roadway section. Also, the traffic control at the network node is generally likewise direction-lane-set specific; that is, it includes different stopping and through-flow times, also referred to as free phases and interruption phases, respectively, for the various direction lane sets.

In another embodiment of the invention, the determined actual traffic information in the form of the one or more traffic situation parameters, determined on a roadway-section specific basis, and preferably especially direction-lane-set-specific, is used continuously for producing historical progress lines relating to the mean number of vehicles in the respective queue, the queue length, the mean waiting time in the respective queue and/or the mean number of vehicles on the respective roadway section.

In still another embodiment of the invention, the direction-lane-set-specific vehicle turn-off rate at a particular network node is taken into account as a further determined traffic situation parameter. That is, the method determines, for a particular time, how many vehicles, on average, are driving from a respective direction lane set of a roadway section entering an associated network node, via the node, into a respective direction lane set of a roadway section continuing on from that network node. This can be determined by means of suitably emphasized FCD; for example, the recorded FCD may contain information about the direction of travel or a change in direction selected at the network node.

In a further embodiment of the method, distinguished identification of the state of subsaturation on the one hand and supersaturation on the other hand is provided from a suitable travel time criterion. In this method, the determined travel time is compared with a threshold value which depends, inter alia, on the roadway section length, a typical free vehicle speed on that roadway section and the stopping and through-flow duration of the traffic control at the network node.

In a further refinement of the invention, traffic parameters are taken into account according to the method to be determined on the basis of different equation systems for the two situations of subsaturation and supersaturation.

A further embodiment of the method according to the invention allows specific, advantageous determination of the number of vehicles on a roadway section and of the effective continuous vehicle inlet flow into the roadway section and into a queue on that roadway section. Traffic data suitable for this purpose are available from two or more appropriate FCD vehicles which are traveling over the relevant roadway section with a time interval between them.

Another embodiment of the method according to the invention allows identification of the state of total overfilling of a roadway section (that is, a state in which the queue extends over the entire roadway section and possibly even farther upstream, beyond the network node there into other roadway sections.)

Another feature of the invention takes account of the inlet flow and outlet flow sources of vehicles as are formed, for example, by car parks and multi-storey car parks in inner city areas.

Finally, in the method developed according to the invention, a "thinned-out" traffic network is considered with regard to traffic situation determination, with a traffic network containing only a portion of all the roadway sections in an overall traffic network on which vehicles can drive, for example, only roadway sections of specific roadway types, such as major traffic roads. The other roadway sections are dealt with as inlet flow and outlet flow sources of vehicles.

Other objects, advantages and novel features of the present invention will become apparent from the following detailed description of the invention when considered in conjunction with the accompanying drawings.

DETAILED DESCRIPTION OF THE DRAWINGS

Figure 1:
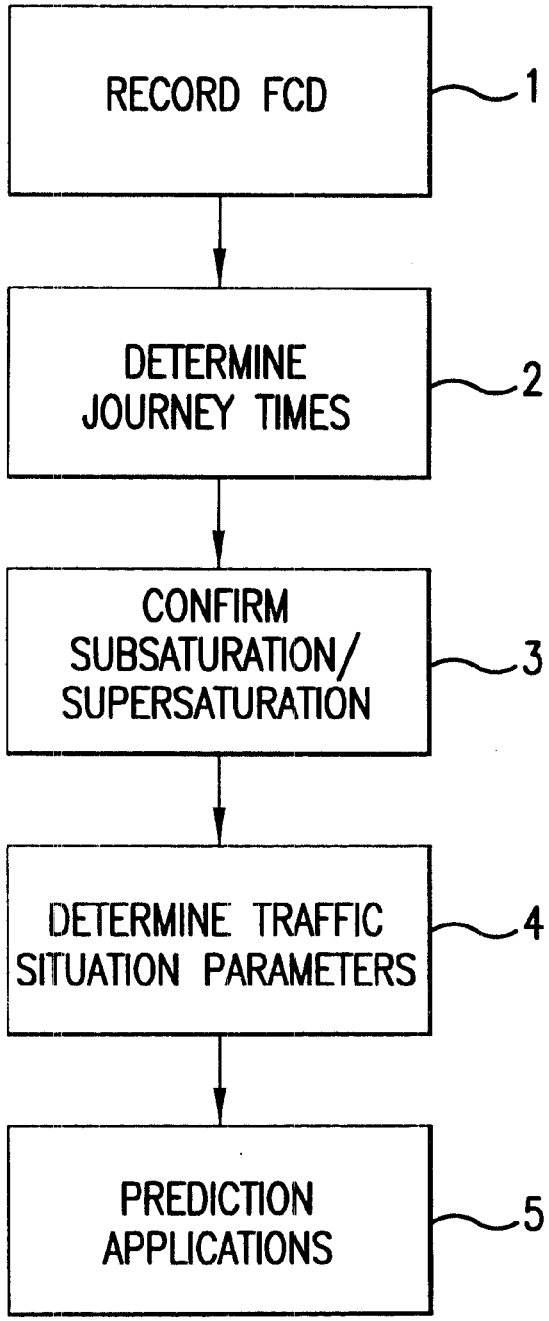
FIG. 1 shows a flowchart of a method for traffic situation determination, for a traffic network with traffic-controlled network nodes, based on FCD.

The method according to the invention will be explained in detail in the following text using an advantageous implementation based on the method sequence illustrated in FIG. 1. The method is suitable for determining or reconstructing the traffic situation in a traffic network with traffic-controlled network nodes, in particular in a road traffic network in a highly populated area. The traffic network under consideration may correspond to an overall traffic network which comprises all the roadway sections on which the associated vehicles can drive in a specific region, or, in a "thinned-out" form, may contain only a portion of the roadway sections of the overall traffic network, for example, only roads above a specific road type minimum size, such as major traffic roads.

The method starts by obtaining traffic data by means of reporting vehicles moving in the traffic (step 1), that is, FCD (floating car data). Such FCD are preferably obtained by means of the method described in German Patent Application mentioned above, which can be referred to for further details. The FCD may in this case be recorded and/or passed on via terminals permanently installed in the vehicles or else, for example, via mobile telephones carried in the vehicles.

Figure 2:
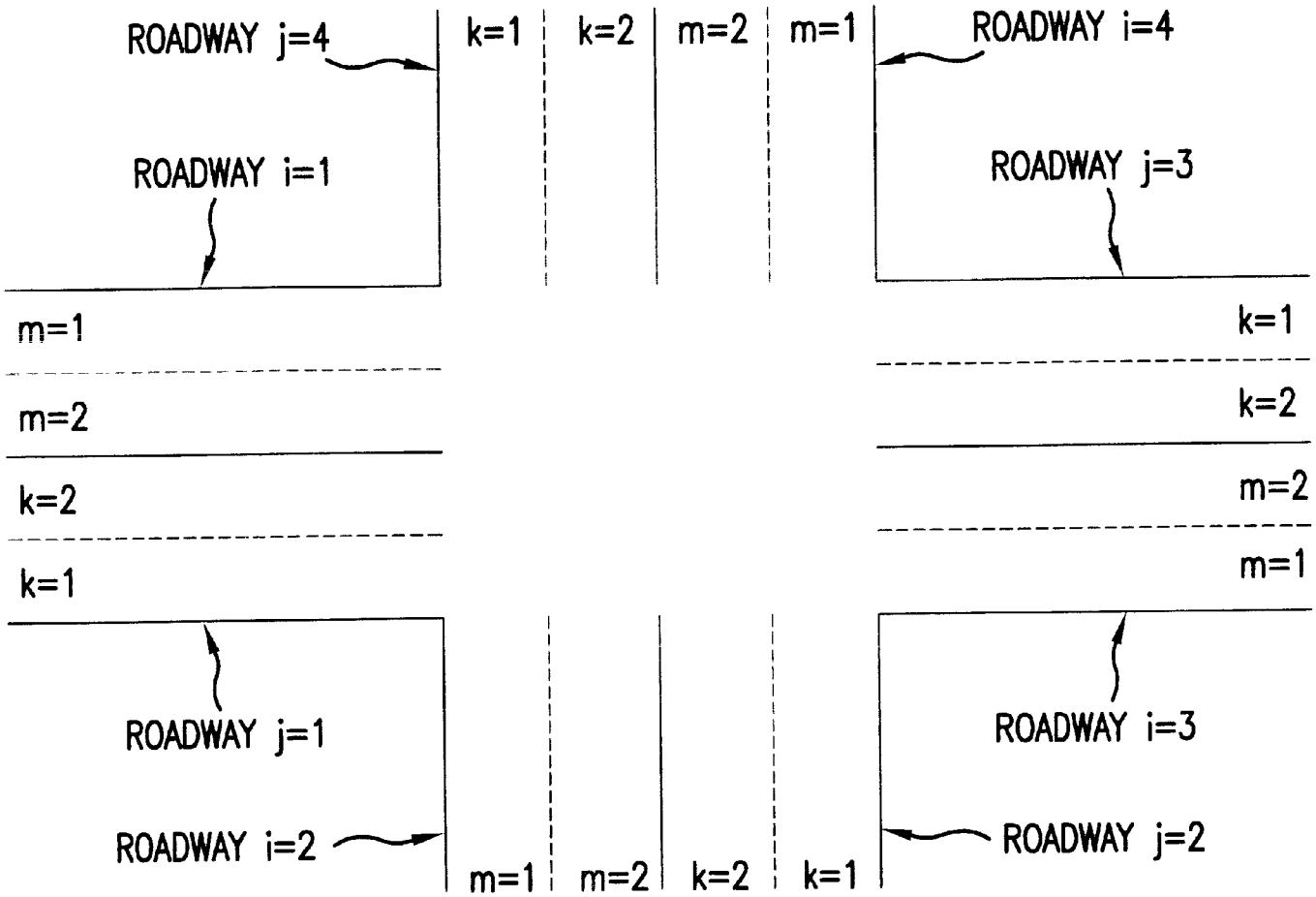
FIG. 2 is an idealized illustration of a network node for explaining the roadway-related terminology used above.

To assist understanding of this method for obtaining FCD and of the roadway-related terminology used in this document, FIG. 2 illustrates an idealized network node, which is entered by four roadway sections j=1, . . . , 4 and from which four roadway sections i=1, . . . , 4 leave. Without any limitation to generality, it is assumed that the incoming roadway sections j each have two different direction lane sets k=1, 2 and the outgoing roadway sections i likewise have two different direction lane sets m=1, 2. Each direction lane set k, m may comprise one or more lanes which can equally be used by vehicles in order to continue driving in one or more specific directions via the network node. For example, one direction lane set of an incoming roadway section may comprise one or more lanes from which it is possible to continue driving straight on or to turn to the right via the network node, while the other direction lane set may comprise one or more lanes from which it is possible to turn to the left.

In the said method for obtaining FCD, processes for obtaining data, at least for network nodes which are traversed successively, are respectively not initiated before leaving a roadway section j which enters the respective network node. Time stamp information is obtained as FCD in the respective process for obtaining data, which information indicates a reporting time relating to the relative network node, and which is not earlier than the time of leaving the relevant roadway section j and is not later than the time at which the reporting vehicle reaches a part of a roadway section i, which will then be driven on, before a next network node under consideration, or enters a queue in the next roadway section i under consideration.

Figure 3:
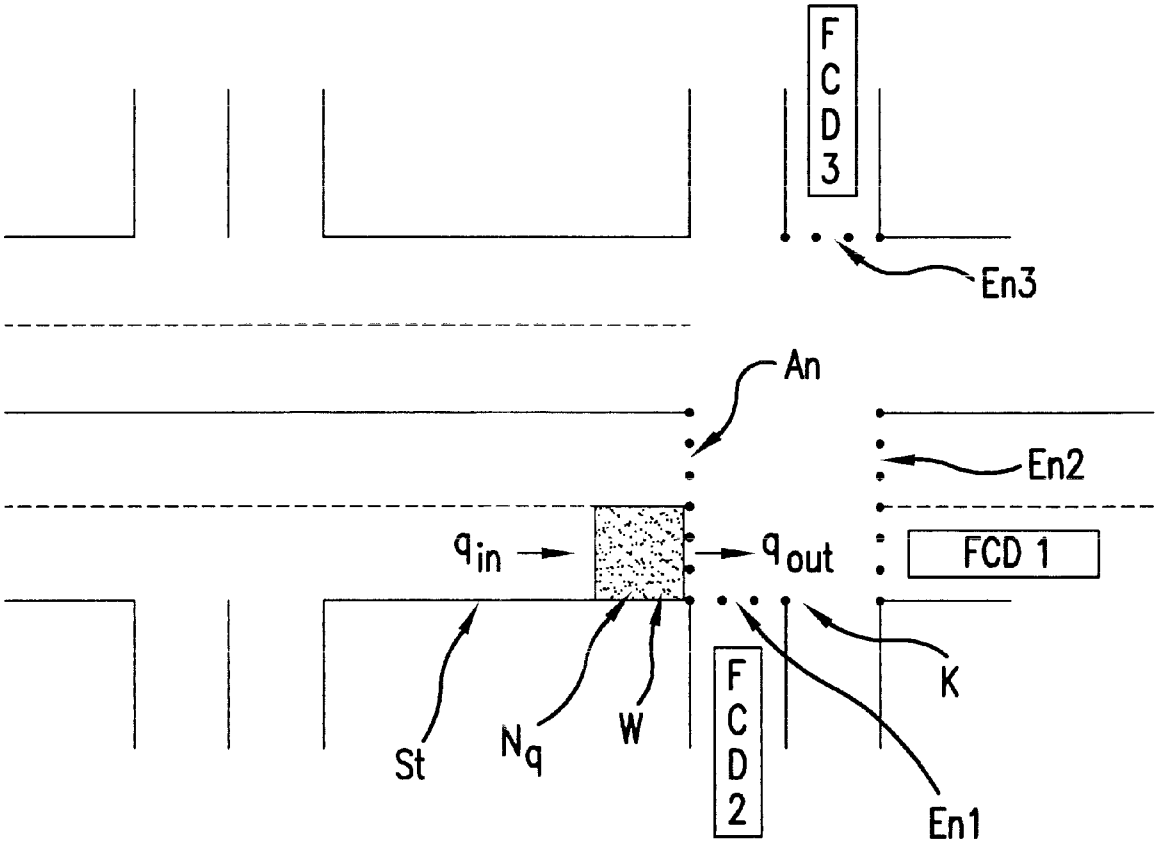
FIG. 3 shows a schematic illustration of a traffic network area with two adjacent network nodes, to illustrate an advantageous way of obtaining FCD.

As stated, the traffic dynamics and the behavior of the traffic disturbances in a traffic network in a highly populated area are generally dominated by the traffic control at the network nodes. In this case, a queue is frequently formed at the end of a roadway section entering an associated network node. FIG. 3 shows, schematically, an example of a record at one instant from the area of a network node K which is entered, inter alia, from a roadway section St at whose end a queue W with an associated number $N_q$ of vehicles has formed before the network node K. The downstream queue end is located at a termination or stop line An, which represents the boundary line of the roadway section St where it enters the network node K. Vehicles enter the queue W in a traffic flow $q_{in,q}$, and vehicles drive out of it and into the network node K in a traffic flow $q_{out}$, in order to enter one of the emerging roadway sections. By way of example, three FCD vehicles FCD1, FCD2, FCD3 are shown, which have left the queue W in the relevant roadway section St and are continuing beyond the network node K in different directions. Specifically, a first FCD vehicle FCD1 is continuing straight on, a second FCD vehicle FCD2 is turning to the right, and a third FCD vehicle FCD3 is turning to the left. The continuing roadway sections start at the corresponding start or boundary lines En1, En2, En3.

The FCD obtained in such a way and containing network-node related reporting time information are, inter alia, particularly suitable for determining, from such data, the travel time $t_{tr}^{(j,k)}$ currently to be expected for the respective roadway section j, separated on the basis of its direction lane set k. The determination of the travel times $t_{tr}^{(j,k)}$ for the one or more direction lane sets k for the roadway section j is carried out as a next step (2) in the sequence of the present method. These travel times $t_{tr}^{(j,k)}$ to be expected at that time can be determined from the FCD obtained for this purpose using any desired conventional algorithm known to a person skilled in the art. In other words, the present method is independent of the way in which the travel times $t_{tr}^{(j,k)}$ for the various roadway sections j of the traffic network are determined from the recorded FCD.

The determined current travel times $t_{tr}^{(j,k)}$ for the direction lane sets k of the roadway sections j of the traffic network are then used to find out whether a state of subsaturation or supersaturation exists for the particular roadway section j, possibly distinguished on the basis of its various direction lane sets k (step 3). The state of subsaturation is in this case defined as that in which the queue which results during a stopping or interruption phase (for example a red traffic light at the end of the roadway section) is cleared completely by the next through-flow or free phase, for example the green phase of the traffic light system, which can be regarded as behavior analogous to the free traffic state on high-speed roads. The state of supersaturation is defined as that in which the queue that occurs during an interruption phase is no longer cleared completely by the subsequent free phase, which can be regarded as behavior analogous to the state of dense traffic on high-speed roads. The greater the number of free phases through which a vehicle has to wait before passing through the traffic-controlled network node located in front of it, the greater is the extent to which the behavior of dense traffic increases in each respective direction lane set of the relevant roadway section in the traffic network in highly populated areas.

In order to determine whether subsaturation or supersaturation exists, the determined travel time $t_{tr}^{(j,k)}$ is compared with a threshold value $t_s^{(j,k)}$, defined by the relationship $$T_s^{(j,k)}=L^{(j,k)}/V_{free}^{(j,k)}(\rho^{(j,k)})+b^{(j,k)}(T_R^{(j,k)-\gamma(j,k)}T_G^{(j,k)}T_R^{(j,k)/T^{(j,k)}}) \quad (1)$$

wherein, for the direction lane set k of the roadway section j, L is the total roadway length, $T_R$ is the duration of the interruption or red phases, $T_G$ is the duration of the free or green phases, $T=T_G+T_R$ is the associated traffic control period duration, β is a suitably predetermined constant and γ is defined by the relationship $$\gamma^{(j,k)}=q_{sat}^{(j,k)}b^{(j,k)}/[n^{(j,k)}v_{free}^{(j,k)}(\rho^{(j,k)})] \quad (2)$$

where, as the boundary condition $\gamma^{(j,k)}$ is in each case kept less than one. Once again, in each case specifically for the direction lane set k of the roadway section j, $q_{sat}$ is a predetermined saturation outlet flow from the queue, b is a mean vehicle interval in queues (a mean queue vehicle periodicity length) and n is the number of lanes. ρ is the mean vehicle density of vehicles driving outside the queue (between the roadway section start and the queue start), and $V_{free}(\rho)$ is the mean vehicle speed (which is dependent on the vehicle density ρ) outside the queue. The mean vehicle speed $V_{free}$ outside the queue can in many cases be approximated by a constant $v_{eff}$ which corresponds to a typical value of $v_{free}$ predetermined independently of the density. The constant β is greater than or equal to zero and is less than one and is generally at, or at about, the value 0.5. The variables $q_{sat}$, $T_G$, $T_R$ and thus T are predetermined characteristic variables or functions of the other variables that are indicative of the traffic situation. Furthermore, all the traffic-related variables mentioned above are generally time-dependent functions, as this expression is understood by a person skilled in the art and which, to improve the clarity, is thus likewise not explicitly stated in the designations of the variables.

In road traffic applications, the parameters b and $q_{sat}$ in this case depend on the vehicle type, in particular on the relative proportions of vehicles whose average lengths differ, such as cars and cargo carrying vehicles. In this case, the parameters b and $q_{sat}$ are each obtained from the sum of the corresponding relative magnitudes of the various types, which, for their part, are each obtained from the product of the relative proportion of the relevant type to the total number of vehicles multiplied by the associated type-specific mean vehicle interval or saturation outlet flow. Where the parameters b and $q_{sat}$ occur in the form of their product $q_{sat}\times b$ in the above equation (2) and in the following equations, it should be mentioned that this product $q_{sat}t\times b$ remains approximately constant for each direction lane set, even when vehicles of different lengths are present, and irrespective of their relative proportions, provided the vehicle density in free-flowing traffic outside the traffic control queues can be assumed to be small in comparison to the vehicle density in the queues. This condition is satisfied to a good approximation in most practically relevant situations.

If the determined travel time $t_{tr}^{(j,k)}$ is less than the threshold value $t_s^{(j,k)}$ thus defined, the subsaturation state is deduced, while the transition to the state of supersaturation is assumed if the determined travel time $t_{tr}^{(j,k)}$ is greater than this threshold value $t_s^{(j,k)}$.

The method now continues by determining traffic situation parameters, which describe the traffic situation, on the basis of the determined travel times $t_{tr}^{(j,k)}$ for the direction lane sets k for the roadway sections j (step 4), with the traffic situation parameters being calculated using different suitable equation systems for the two states of subsaturation and supersaturation, in order then to reconstruct or to determine the current traffic situation from them. This preferably includes, in each case specifically for each direction lane set k for the respective roadway section j, calculation of the mean total number N of vehicles, the mean number $N_q$ of vehicles in the queue, and the mean vehicle density ρ of the vehicles traveling outside the queue. From this information, the mean speed $v_{free}$ of the vehicles outside the queue, the mean queue length $L_q$ and the mean queuing time $t_q$ in the queue can be determined.

This is done using the following equation system for the subsaturation situation:

$$\rho^{(j,k)} = \frac{N^{(j,k)} - N_q^{(j,k)}}{n^{(j,k)}\left(L^{(j,k)} - L_q^{(j,k)}\right)} \tag{3}$$

$$N^{(j,k)} = q_{sat}^{(j,k)} t_{tr}^{(j,k)} \frac{t_{tr}^{(j,k)} - \left[L^{(j,k)} / v_{free}^{(j,k)}(\rho^{(j,k)})\right] - \beta^{(j,k)}\left(T_R^{(j,k)}\right)^2 / T^{(j,k)}}{t_{tr}^{(j,k)} - \left[L^{(j,k)} / v_{free}^{(j,k)}(\rho^{(j,k)})\right] - \gamma^{(j,k)}\beta^{(j,k)}\left(T_R^{(j,k)}\right)^2 / T^{(j,k)}} \tag{4}$$

$$N_q^{(j,k)} = q_{sat}^{(j,k)}\left[t_{tr}^{(j,k)} - L^{(j,k)} / v_{free}^{(j,k)}(\rho^{(j,k)}) - \beta^{(j,k)}\left(T_R^{(j,k)}\right)^2 / T^{(j,k)}\right] / (1 - \gamma^{(j,k)}) \tag{5}$$

$$L_q^{(j,k)} = b^{(j,k)} N_q^{(j,k)} / n^{(j,k)} \tag{6}$$

$$t_q^{(j,k)} = \left[t_{tr}^{(j,k)} - L^{(j,k)} / v_{free}^{(j,k)}(\rho^{(j,k)}) - \gamma^{(j,k)}\beta^{(j,k)}\left(T_R^{(j,k)}\right)^2 / T^{(j,k)}\right] / (1 - \gamma^{(j,k)}) \tag{7}$$

This takes account of the fact that the determined mean travel time $t_{tr}^{(j,k)}$ is the sum of the waiting time $t_q^{(j,k)}$ in the queue and the mean travel time $t_{free}^{(j,k)}$ for the roadway, from its start to the queue start; that is, as far as the upstream end of the queue, with the latter being obtained from the relationship $$t_{free}^{(j,k)} = (L^{(j,k)} - L_q^{(j,k)} / v_{free}^{(j,k)}\ (r^{(j,k)}) \tag{8}$$

Furthermore, since the queue length $L_q$ cannot be less than zero, the travel time $t_{tr}$ cannot be less than a minimum travel time $t_{tr,min}=L/v_{free}+\beta T_R^2/T$ for driving over the roadway section when it is completely free of vehicles. This is checked in the subsaturation situation in all the calculations and, if necessary, the travel time $t_{tr}$ is limited at the lower end to the minimum value $t_{tr,min}$. The total number N of vehicles on the direction lane set k for the roadway section j is given by the relationship:

$$N^{(j,k)} = N_q^{(j,k)} t_{tr}^{(j,k)} / t_q^{(j,k)} \tag{9}$$

where the quotient $q_{in,q}^{(j,k)}=N_q^{(j,k)}/t_q^{(j,k)}$ indicates the mean inlet flow into the queue.

For the supersaturated situation, the above equations 3 and 6 still apply to the mean vehicle density ρ outside the queue and to the mean queue length $L_q$ while in the equation system which is applicable in this case, the above equations 4, 5 and 7 for the mean total number of vehicles N, the mean number $N_q$ of vehicles in the queue and the mean waiting time $t_q$ in the queue are each replaced by the following relationships, in each case related to the direction lane set k for the roadway section j:

$$N^{(j,k)} = t_{tr}^{(j,k)} q_{sat}^{(j,k)} T_G^{(j,k)} / T^{(j,k)} \tag{10}$$

$$N_q^{(j,k)} = q_{sat}^{(j,k)} T_G^{(j,k)}\left[t_{tr}^{(j,k)} - L^{(j,k)} / v_{free}^{(j,k)}(\rho^{(j,k)})\right] / \left[(I - \gamma_i^{(j,k)}) T^{(j,k)}\right] \tag{11}$$

$$t_q^{(j,k)} = N_g^{(j,k)} T^{(j,k)} / (T_G^{(j,k)} q_{sat}^{(j,k)}). \tag{12}$$

In this case $\gamma_1$ is defined by $\gamma_1^{(j,k)}=\gamma^{(j,k)}T_G^{(j,k)}/T^{(j,k)}$, using the parameter γ defined in the above equation 2, and with the formal boundary condition $\gamma_1<1$ once again being applicable in this case. The obvious boundary condition $L\geqq L_q=bN_q/n$, also applies to the supersaturated situation since the queue associated with a roadway section cannot be longer than the roadway itself. Furthermore, the total number of vehicles N is subject to the trivial boundary condition that it cannot be greater than the maximum possible number $N_{max}=nL/b$ of vehicles on the roadway's length L. In a corresponding way, the roadway section travel time $t_{tr}$ cannot be greater than the maximum waiting time $t_{q,max}=N_{max}T/(T_G q_{sat})$ in a queue extending over the entire roadway section. A check is therefore carried out in all the calculations in the supersaturated situation to determine whether the travel time $t_{tr}$ is less than the maximum value $t_{q,max}$, otherwise it is limited to this value.

It is thus possible by solving the respective coupled equation system to determine both for the subsaturated situation and the supersaturated situation the major parameters governing the traffic situation. These include the mean vehicle density ρ, the mean number of vehicles N, the mean number $N_q$ of vehicles in the queue, the mean queue length $L_q$ and the mean waiting time $t_q$ in the queue for each direction lane set k of each roadway section j in the traffic network on the basis of the mean travel times $t_{tr}^{(j,k)}$ determined with FCD assistance. That is, it is thus possible to reconstruct the current traffic situation just from suitably recorded FCD representing traffic data recorded on a sample basis.

In most cases, for both the subsaturated situation and the supersaturated situation, it is justifiable for simplicity, to set the mean vehicle speed $v_{free}^{(j,k)}$ $(\rho^{(j,k)})$ intrinsically dependent on the vehicle density, to an effective speed value $v_{eff}^{(j,k)}$ which is predetermined as a constant for the respective direction lane set k of the roadway section j, independently of the vehicle density ρ.

In order to determine the traffic situation parameters comprising the number of vehicles $N^{(j,k)}$ on the relevant direction lane set k of the roadway section j and the effective continuous inlet flow $q_{in}^{(j,k)}$ into the relevant direction lane set k of the roadway section j and the effective continuous inlet flow $q_{in,q}^{(j,k)}$ into the relevant queue, it is possible (if required) to use a procedure making use of the difference $\Delta t_{tr}^{(j,k)}$ between the travel times $t_{tr}^{(j,k)}$ of at least two FCD vehicles which are traveling through the same direction lane set k of the roadway section j with an adequate time interval $\Delta t^{(j,k)}$. This time interval $\Delta t^{(j,k)}$ must in this case be greater than or equal to the traffic control period duration $T^{(j,k)}$ and the mean travel time $t_{tr}^{(j,k)}$ for this situation is averaged from individual travel time values over the queue period duration $T^{(j,k)}$. To be more precise, the time interval $\Delta t^{(j,k)}$ is the time difference between the times at which the relevant FCD vehicles enter the same direction lane set k of the roadway section j.

In particular, the roadway section inlet flow $q_{in}$ can in this case be described specifically for the respective direction lane set k of the roadway section j by the relationship $$q_{in}^{(j,k)}=(1+\Delta t_{tr}^{(j,k)}/\Delta t^{(j,k)})q_{sat}^{(j,k)}T_G^{(j,k)}/T^{(j,k)} \tag{13}$$

using the approximation $_{tfree}^{(j,k)} \ll \Delta t^{(j,k)}$. This is generally very justifiable in highly populated areas; that is, the difference $_{Tfree}^{(j,k)}$ between the travel times from the roadway section start to the queue start for two FCD vehicles which are following one another and enter the relevant direction lane set k of the roadway section j with a time interval $\Delta t^{(j,k)}$ is considerably less than the difference $_{\Delta t}^{(j,k)}$ between the waiting times of the FCD vehicles in the queue. Furthermore, this relationship includes the precondition that there are no vehicle flow sources or sinks on the relevant direction lane set k of the roadway section j.

In inner city areas, for example, such sources and sinks can be formed by multi-storey car parks and car parks. In this situation, there is a corresponding inlet flow $_{Tq}^{(j,k)}$ and outlet flow $_{Ts}^{(j,k)}$ of vehicles for the respective direction lane set k of the roadway section j. This can be taken into account, inter alia, in the above equation 12 for the mean roadway section inlet flow by replacing the variable $q_{in}^{(j,k)}$ on the left-hand side of the equation by the expression $q_{in}^{(j,k)}-_{Ts}^{(j,k)}+_{Tq}^{(j,k)}$. In an analogous manner, such sources and sinks of vehicle flow can also be taken into account as an appropriate vehicle flow correction when determining the other parameters, as described above, which are relevant to the traffic situation. If the traffic network under consideration has been "thinned-out" as mentioned above, those roadway sections and associated network nodes which have been ignored, can be regarded as further vehicle flow sources and sinks.

Modern traffic light systems and similar traffic control facilities at network nodes are frequently controlled by the amount of traffic. That is, the free-phase and interruption phase durations vary as a function of the amount of traffic so that, for example, for a direction lane set on which a relatively long queue has already formed, the free phase duration is increased above its normal value in order once again to shorten the excessively long queue. In other words, the interruption phase duration $T_R$, the free phase duration $T_G$, and thus the cycle time T defined by the sum of these two time durations, are functions which depend not only on the roadway section j, the direction lane set k and time, but also on one or more variables which are indicative of the traffic situation, such as the vehicle flow, etc. In order to allow global statements on the traffic situation which are independent of such local fluctuations in the traffic control measures which are dependent on the amount of traffic, it is expedient in these situations to use mean values for the free and interruption phase durations and the cycle times, that is, the traffic control period durations with said mean values being obtained by averaging over time intervals which are considerably longer than the typical cycle time uninfluenced by the amount of traffic.

Although, in general, it is preferable to determine the various variables mentioned above on the basis of the index k used, specifically for the direction lane sets, these variables may, of course, also be determined just on a roadway section specific basis, without any further distinction between individual direction lane sets. In particular, associated variables which are only roadway section specific can be derived from the above variables which are specific to the direction lane set and the roadway section, by additive analysis of all the direction lane sets for a respective roadway section. For example, it is thus possible to derive a mean number $N^{(j)}$ of vehicles on the roadway section j, a mean number $N_q^{(j)}$ of vehicles in all the queues on the roadway section j, from this a mean number of vehicles $N_s^{(j)}$ per lane and a mean number of vehicles in the queue $N_{sq}^{(j)}$ per lane and, from this, a mean queue length $L_q^{(j)}$ which is purely roadway section specific, and a mean waiting time $t_q^{(j)}$, which is likewise purely roadway section specific, from the following relationships:

$$N^{(j)} = \sum_{k=1}^{K^{(j)}} N^{(j,k)} \tag{14}$$

$$N_\gamma^{(j)} \sum_{k=1}^{K^{(j)}} N_q^{(j,k)} \tag{15}$$

$$N_s^{(j)} = N^{(j)} \Big/ \sum_{k=1}^{K^{(j)}} n^{(j,k)} \tag{16}$$

$$N_{sq}^{(j)} = N_q^{(j)} \Big/ \sum_{k=1}^{K^{(j)}} n^{(j,k)} \tag{17}$$

$$L_q^{(j)} = b^{(j)} N_{sq}^{(j)} \tag{18}$$

-continued $$t_{sq}^{(j)} = \left[\sum_{k=1}^{k^{(j)}} t_q^{(j,k)}\right] \Big/ K^{(j)} \tag{19}$$

with $t_q^{(j,k)}$ from the above equation 12 for the supersaturated situation, $K^{(j)}$ being the number of direction lane sets for the roadway section j and $b^{(j)}$ being the mean vehicle length. If $q_{sat}^{(j,k)}$ and $T^{(j,k)}$ each have the same values for all the direction lane sets k for a roadway section j, the above equation 19 is simplified in a corresponding manner.

Furthermore the present method makes it possible to find out whether the respective direction lane set k for the roadway section j is totally overfilled with the vehicles in the queue. This is the situation when the queue length $L_q^{(j,k)}$ corresponds to the section length $L^{(j,k)}$, that is to say when the relationship $$b^{(j,k)} N_q^{(j,k)} / n^{(j,k)} = L^{(j,k)} \tag{20}$$

is satisfied, $N_q^{(j,k)}$ being determined using the above equation 11 for the supersaturated situation. That travel time $t_{tr,crit}^{(j,k)}$, for which this criterion (equation 14) is satisfied is referred to as the critical travel time. In this situation, if the difference $t-t_2^{(j,k)}$ between the current time t and the time $t_2^{(j,k)}$ when the relevant FCD vehicle entered the direction lane set k of the roadway section j is greater than this critical travel time $t_{tr,crit}^{(j,k)}$, then this can be used as a criterion that an overfilled direction lane set k of a roadway section j in a traffic network in a highly populated area is blocking one or more upstream roadway sections beyond one or more corresponding network nodes.

It is self-evident that, depending on the application, instead of the traffic situation parameters mentioned explicitly above, it is possible to use only some of these parameters, and/or further traffic situation parameters, for mean travel times. These are determined on the basis of FCD support, are roadway section specific, and are at the same time preferably direction-lane-set-specific. Thus, for example, the current turn-off rates at a particular network node can be taken into account and determined in the form of a matrix as further traffic situation parameters, with the elements of such a matrix indicating the rates at which vehicles from a respective direction lane set of an entering roadway section enter a respective direction lane set of an emerging roadway section via the relevant network node.

The determination of the traffic situation parameters, and thus of the traffic situation, as explained above, can be used for corresponding further applications, as required. In particular, the data determined according to the method and relating to the mean number of vehicles in the respective queue, the queue length, the mean waiting time in the queue and the mean number of vehicles on the respective direction lane set of a roadway section, and relating to current turn-off rates, can be used on a continuous basis for producing historical progress lines for the associated variables that are relevant to the traffic situation. A progress line database and a corresponding progress-line-based traffic prediction system can thus be set up, for example, for travel time prediction. For this purpose, a traffic control center is equipped with a memory in which the corresponding information about the traffic control measures of the network nodes and about travel times for all the roadway sections in a road traffic network in a highly populated area is stored on the basis of a digital road map. A processing unit in the traffic control center can receive current information about the traffic control period durations and the free phase and interruption phase durations for the traffic-controlled crossings and about the current travel times which are determined with FCD assistance and are specific to the roadway section. A computation unit in the traffic control center is then able to use such data to make travel time predictions automatically for any desired journey in the traffic network by means of dynamic traffic prediction and/or traffic prediction based on progress lines (step 5).

Dynamic prediction of the development of the traffic is feasible, for example, using the method described German Patent Document No. 199 40 957 cited above. The predicted traffic data can then be compared with currently available traffic data, from which comparison it is possible to derive an error correction for the prediction method by correcting the determined current values, for example for the turn-off rates and other parameters relevant to the traffic situation and/or the corresponding values for the historical progress lines, as a function of the discrepancies which may be found in the comparison.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for determining a traffic situation based on traffic data obtained by reporting vehicles moving in the traffic, for a traffic network with traffic-controlled network nodes and roadway sections connecting them, said method comprising:

reporting vehicles moving in the traffic obtaining traffic data indicative of travel times ($t_{tr}^{(j,k)}$) on particular roadway sections (j, k);

determining roadway specific travel times for the particular roadway sections from the traffic data obtained; and determining at least one of the following traffic situation parameters from the roadway-section specific travel times:

(i) a mean number ($N_q^{(j,k)}$) of vehicles in a queue at the particular roadway section (j, k) before an associated traffic-controlled network node;

(ii) a mean number ($N^{(j,k)}$) of vehicles on the particular roadway section (j, k);

(iii) a mean speed ($V_{free}^{(j,k)}$ of vehicles on the particular roadway section (j, k) between a roadway section start and a queue start;

(iv) a mean waiting time ($t_q^{(j,k)}$) in a network node queue on the particular roadway section (j, k); and (v) a mean density ($p^{(j,k)}$) of vehicles on the particular roadway section (j, k) between the roadway section start and the queue start.

2. The method according to claim 1, wherein the travel times ($t_{tr}^{(j,k)}$) and the traffic situation parameter or parameters are determined specifically for each direction lane set (k) of the particular roadway section (j).

3. The method according to claim 1, wherein the traffic situation parameter value or values obtained from the determined roadway-section specific travel times are used continuously for producing at least one of:

historical progress lines relating to the mean number of vehicles in a particular queue;

length of the particular queue;

mean waiting time in the queue and/or the mean number of vehicles on the particular roadway section (j, k).

4. The method according to claim 1, wherein turn-off rates are used as further traffic situation parameters obtained from determined roadway-section specific travel times, which turn-off rates in each case indicate a rate of vehicles which travel from an incoming direction lane set via a network node into an outgoing direction lane set.

5. The method according to claim 1, wherein:

a threshold value ($t_s^{(j,k)}$) is predetermined in accordance with the relationship $$(t_S^{(j,k)})=L^{(j,k)}/V_{free}^{(j,k)}(p^{(j,k)})+\beta^{(j,k)}(T_R^{(j,k)}-\gamma^{(j,k)}T_G^{(j,k)}T_R^{(j,k)}/T^{(j,k)})$$

for distinguishing between a subsaturated state on the one hand and a supersaturated state on the other hand;

subsaturation of the particular roadway section (j, k) is deduced if the determined travel time ($t_{tr}^{(j,k)}$) is less than the threshold value ($ts^{(j,k)}$); and supersaturation is deduced if the determined travel time is greater than the threshold value; with $L^{(j,k)}$ being the length of the roadway section (j, k);

$T_R^{(j,k)}$ being a traffic control interruption phase duration;

$T_G^{(j,k)}$ being a traffic control free phase duration;

$T^{(j,k)}=T_G^{(j,k)}+T_R^{(j,k)}$ being a traffic control period duration;

$V_{free}^{(j,k)}$ ($p^{(j,k)}$) being a vehicle-density-dependent mean vehicle speed outside the queue;

$\beta^{(j,k)}$ being a constant, which can be determined, that is greater than or equal to zero and less than one;

$$\gamma^{(j,k)}=q_{sat}^{(j,k)}b^{(j,k)}/[n^{(j,k)}V_{free}^{(j,k)}(p^{(j,k)})];$$

$q_{sat}^{(j,k)}$ being a queue saturation outlet flow of the particular roadway section (j, k);

$b^{(j,k)}$ being a mean vehicle interval in the queue; and $n^{(j,k)}$ being a number of lanes.

6. The method according to claim 1, wherein the roadway-section-specific vehicle situation parameters comprising the mean vehicle density ($p^{(j,k)}$) outside the queue, the mean number of vehicles ($N^{(j,k)}$), the mean number of vehicles in the queue ($N_q^{(j,k)}$), queue length ($L_q^{(j,k)}$) and waiting time ($t_q^{(j,k)}$) in the queue for the subsaturated state are obtained by means of the following equation system:

$$\rho^{(j,k)}=\frac{N^{(j,k)}-N_q^{(j,k)}}{n^{(j,k)}(L^{(j,k)}-L_q^{(j,k)})}$$

$$N^{(j,k)}=q_{sat}^{(j,k)}t_{tr}^{(j,k)}\frac{t_{tr}^{(j,k)}-[L^{(j,k)}/v_{free}^{(j,k)}(\rho^{(j,k)})]-\beta^{(j,k)}(T_R^{(j,k)})^2/T^{(j,k)}}{t_{tr}^{(j,k)}-[L^{(j,k)}/v_{free}^{(j,k)}(\rho^{(j,k)})]-\gamma^{(j,k)}\beta^{(j,k)}(T_R^{(j,k)})^2/T^{(j,k)}}$$

$$N_q^{(j,k)}=q_{sat}^{(j,k)}[t_{tr}^{(j,k)}-L^{(j,k)}/v_{free}^{(j,k)}(\rho^{(j,k)})-\beta^{(j,k)}(T_R^{(j,k)})^2/T^{(j,k)}]/(1-\gamma^{(j,k)})$$

$$L_q^{(j,k)}=b^{(j,k)}N_q^{(j,k)}/n^{(j,k)}$$

$$t_q^{(j,k)}=[t_{tr}^{(j,k)}-L^{(j,k)}/v_{free}^{(j,k)}(\rho^{(j,k)})-\gamma^{(j,k)}\beta^{(j,k)}(T_R^{(j,k)})^2/T^{(j,k)}]/(1-\gamma^{(j,k)})$$

and for the supersaturated state are obtained by means of the following equation system:

$$\rho^{(j,k)}=\frac{N^{(j,k)}-N_q^{(j,k)}}{n^{(j,k)}(L^{(j,k)}-L_q^{(j,k)})}$$

$$N^{(j,k)}=t_{tr}^{(j,k)}q_{sat}^{(j,k)}T_G^{(j,k)}/T^{(j,k)}$$

$$N_q^{(j,k)}=q_{sat}^{(j,k)}T_G^{(j,k)}[t_{tr}^{(j,k)}-L^{(j,k)}/v_{free}^{(j,k)}(\rho^{(j,k)})]/[(1-\gamma_1^{(j,k)})T^{(j,k)}]$$

-continued $$L_q^{(j,k)}=b^{(j,k)}N_q^{(j,k)}/n^{(j,k)}$$

$$t_q^{(j,k)}=N_q^{(j,k)}T^{(j,k)}/(T_G^{(j,k)}q_{sat}^{(j,k)}),$$

where $$\gamma^{(j,k)}=q_{sat}^{(j,k)}b^{(j,k)}/[n^{(j,k)}V_{free}^{(j,k)}(p^{(j,k)})];$$

$$\gamma_1^{(j,k)}=\gamma^{(j,k)}T_G^{(j,k)}/T^{(j,k)};$$

in each case specifically for a particular direction lane set k of a particular roadway section j;

L is the total roadway length;

$T_R$ is the duration of the interruption or red phases;

$T_G$ is the duration of the free or green phases;

$T=T_G+T_R$ is an associated traffic control period duration;

$q_{sat}$ is a predetermined saturation outlet flow from the queue;

b is a mean vehicle interval in queues;

n is a number of lanes;

$v_{free}$ is the mean vehicle speed, dependent on the vehicle density outside the queue; and $\beta$ is a suitably predetermined constant.

7. The method according to claim 1, wherein:

traffic situation parameters comprising the mean number of vehicles ($N^{(j,k)}$), effective continuous roadway section inlet flow ($q_{in}^{(j,k)}$) and effective continuous queue inlet flow ($q_{in/q}^{(j,k)}$) are obtained from traffic data from at least two reporting vehicles which are traveling at a time interval ($\Delta t^{(j,k)}$) greater than or equal to a traffic control period duration ($T^{(j,k)}$) on the same roadway section (j, k), using the difference ($\Delta t_{tr}^{(j,k)}$) between determined travel times of the reporting vehicles; and the relationship;

$$q_{in}^{(j,k)}=(1+\Delta t_{tr}^{(j,k)}/\Delta t^{(j,k)})qsat^{(j,k)}T_G^{(j,k)}/T^{(j,k)}$$

and the approximation $$\Delta t_{free}^{(j,k)}<<\Delta t^{(j,k)}$$

are in this case used to determine an effective continuous roadway section inlet flow ($q_{in}^{(j,k)}$), $t_{free}$ being a travel time difference from the roadway section start to the queue start.

8. The method according to claim 1, wherein:

an overfull roadway section is deduced if a reporting vehicle is located on the relevant roadway section (j, k) for a time period greater than a critical travel time ($t_{tr,crit}^{(j,k)}$), being a determined travel time that satisfies an implied relationship $$b^{(j,k)}N_q^{(j,k)}/n^{(j,k)}=L^{(j,k)}$$

where the mean number of vehicles in the queue ($N_q^{(j,k)}$) is that for a supersaturated case.

9. The method according to claim 1, wherein sources and sinks of vehicle flow on the traffic network are taken into account in determining traffic situation parameters by means of corresponding inlet flows ($_{Tq}^{(j,k)}$) and outlet flows ($_{Ts}^{(j,k)}$) to and from the particular roadway section (j, k).

10. The method according to claim 9, wherein:

the traffic network which is considered for determining the traffic situation comprises only a predeterminable portion of all roadway sections and network nodes in an overall traffic network; and roadway sections and network nodes that are not considered in this case are regarded as sources and sinks of vehicle flow on the traffic network under consideration.

* * * * *